US005567277A

United States Patent [19]

Elliott et al.

[11] Patent Number: 5,567,277

[45] Date of Patent: Oct. 22, 1996

[54] CELLULOSIC, MODIFIED LIGNIN AND CATIONIC POLYMER COMPOSITION AND PROCESS FOR MAKING IMPROVED PAPER OR PAPERBOARD

[75] Inventors: David L. Elliott, Imperial; Wood E. Hunter, Pittsburgh; Ronald J. Falcione, Canonsburg, all of Pa.

[73] Assignee: Calgon Corporation, Pittsburgh, Pa.

[21] Appl. No.: 566,469

[22] Filed: Dec. 4, 1995

Related U.S. Application Data

[63] Continuation-in-part of Ser. No. 483,645, Jun. 7, 1995, Pat. No. 5,501,773, which is a continuation of Ser. No. 69,258, May 28, 1993, abandoned.

[51] Int. Cl.[6] ..... D21H 21/10

[52] U.S. Cl. ..... 162/163; 162/168.2; 162/168.3; 162/183

[58] Field of Search ..... 162/163, 168.2, 162/168.3, 183

[56] References Cited

U.S. PATENT DOCUMENTS

| | | | |
|---|---|---|---|
| 3,180,787 | 4/1965 | Adams | 162/163 |
| 3,758,377 | 11/1973 | Fife | 428/486 |
| 3,849,184 | 11/1974 | Roberts | 106/117 |
| 3,874,994 | 4/1975 | Sedlak | 162/168.3 |
| 3,985,937 | 10/1976 | Fife | 428/486 |
| 4,145,246 | 3/1979 | Goheen et al. | 162/23 |
| 4,313,790 | 2/1982 | Pelton et al. | 162/163 |
| 4,347,100 | 8/1982 | Brucato | 162/10 |
| 4,388,150 | 6/1983 | Sunden et al. | 162/175 |
| 4,606,790 | 8/1986 | Youngs et al. | 162/125 |
| 4,643,801 | 2/1987 | Johnson | 162/164.1 |
| 4,772,332 | 9/1988 | Nemeh et al. | 106/487 |
| 4,913,775 | 4/1990 | Langley et al. | 162/168.3 |
| 5,098,520 | 3/1992 | Begala | 162/168.1 |
| 5,110,414 | 5/1992 | Forss et al. | 162/163 |
| 5,185,062 | 2/1993 | Begala | 162/168.1 |

FOREIGN PATENT DOCUMENTS

| | | |
|---|---|---|
| 362770 | 4/1990 | European Pat. Off. . |
| 477209 | 10/1975 | U.S.S.R. . |

OTHER PUBLICATIONS

"A Visual Perspective On Microparticles" –TAPPI, Papermakers Conference Proceedings, Book 1, pp. 115–186 (Atlanta, Georgia –Apr. 18–21, 1993) –Kurt Moberg, et al.

"Application Of Polymeric Flocculant In Newsprint Stock Systems For Fines Retention Improvement" –TAPPI, The Journal Of The Technical Association Of The Pulp And Paper Industry, vol. 63, No. 6, pp. 63–66 (Jun. 1980) Authored by C. H. Tay.

"Wood Pulp Washing –2. Displacement Washing Of Aqueous Lignin From Model Beds With Cationic Polymer Solutions" –Colloids And Surfaces, vol. 64, pp. 223–234 (1992) –Co–authored by P. Li and R. Pelton.

"Effect Of Kraft Black Liquor And NSSC Spent Liquor Components On Polymeric Additive Performance" –TAPPI, Contaminant Problems And Strategies In Wastepaper Recycling, Seminar Notes (Madison, Wisconsin) pp. 91–96 (Apr. 24–26, 1989) –Authored by T. H. Wenger.

"Kinetics Of Complex Formation Between Cationic Polymers And Dissolved Wood Polymers" –EUCEPA/ATICELCA, Devt. & Trends in Sci. & Technol. of Pulp & Pmkg., vol. 2, Paper No. 31, pp. 1–22 (Oct. 6–10, 1986) –Co–authored by D. Ahrabi, L. Odberg and G. Strom.

*Primary Examiner*—Peter Chin
*Attorney, Agent, or Firm*—Craig G. Cochenour

[57] ABSTRACT

A composition comprising an aqueous cellulosic furnish, a high molecular weight cationic polymer, and an anionic polymer comprising a modified lignin wherein the ratio of the cationic polymer to the anionic polymer is from about 10:1 to 1:10 on an active basis is disclosed. A process employing this composition for making paper or paperboard having improved drainage, retention and formation properties is also provided.

12 Claims, No Drawings

CELLULOSIC, MODIFIED LIGNIN AND CATIONIC POLYMER COMPOSITION AND PROCESS FOR MAKING IMPROVED PAPER OR PAPERBOARD

This Application is a Continuation-In-Part Application under 37 CFR 1.53 of U.S. patent application Ser. No. 08/483,645, filed Jun. 7, 1995, now U.S. Pat. No. 5,501,773, which is a continuation application of U.S. patent application Ser. No. 08/069,258 filed May 28, 1993, abandoned.

BACKGROUND OF THE INVENTION

1. Field of the Invention

This invention relates to a composition comprising an aqueous cellulosic furnish, cationic polymer and a modified lignin and methods using the composition for making paper or paperboard having improved properties in the areas of drainage, retention and formation.

2. Brief Description of the Background Art

In the production of paper or paperboard from a dilute aqueous cellulosic furnish improvements in retention and drainage and in the formation properties of the final paper or paperboard sheet are particularly desirable. It is well known by those skilled in the art that these parameters are frequently in conflict with each other. For example, if the cellulosic fibers of the aqueous cellulosic furnish are flocculated effectively to larger flocs, retention of, for example, fiber fines and filler is generally good and can result in a porous structure yielding generally good drainage; however, formation is poor. In this light, conventional practice has resulted in those skilled in the art selecting one or more additives to improve the production of paper or paperboard according to the parameters that are most important to achieve. Alternatively, if the cellulosic fibers are flocculated to a lesser degree, drainage and retention are less satisfactory; however, formation is improved. Further, drainage and retention are often in conflict with each other when, for example, increased production of paper or paperboard is desired over the need for retention of, such as for example, fillers and the like.

Retention is believed to be a function of different mechanisms such as filtration by mechanical entrainment, electrostatic attraction and bridging between aqueous cellulosic fibers and filler. Because both cellulose and many common fillers are electronegative, they are mutually repellant and, in the absence of a retention aid, the only factor tending to enhance retention is mechanical entrainment.

Drainage relates to the rate at which free water is released from a sheet as it is being formed. Thus, it will be appreciated that drainage aids improve the overall efficiency of dewatering in the production of paper or paperboard.

Formation relates to the formation of the paper or paperboard sheet produced from the papermaking process. Formation is generally evaluated by the variance in light transmission within a paper sheet. A high variance is indicative of poor formation. It is generally well known by those skilled in the art that as the retention level increases, the level of formation generally decreases from good formation to poor formation.

A variety of compositions and processes have been proposed to improve retention, drainage, or formation to improve the papermaking process.

U.S. Pat. No. 4,913,775 (Langley et al) discloses a process of making paper or paper board comprising passing an aqueous cellulosic suspension through one or more shear stages, draining the suspension to form a sheet and drying the sheet wherein an improved combination of retention, drainage, drying and formation is achieved by adding to the suspension an excess of high molecular weight linear synthetic cationic polymer before shearing the suspension and adding bentonite after shearing.

U.S. Pat. No. 4,643,801 (Johnson) discloses a paper making process in which paper making stock containing a sufficient amount of cellulosic pulp is formed into a sheet and dried and to which is added prior to formation of the sheet a coacervate binder comprising a cationic starch, a high molecular weight anionic polymer and a dispersed silica.

U.S. Pat. No. 4,388,150 (Sunden et al) discloses a paper making process and an improved cellulosic paper product. This patent states that a paper making process is provided in which an aqueous papermaking stock containing a sufficient amount of cellulosic pulp is formed and dried, wherein the improvement comprises providing in the stock prior to the formation of the sheet a binder comprising colloidal silica acid having an average particle size less than 20 nanometers and cationic starch. This patent states that the cationic starch and the colloidal silica acid are admixed with each other in the presence of cellulosic fiber to form a complex of cationic starch and colloidal silica acid which serves as a binder for the cellulosic fibers.

U.S. Pat. No. 5,098,520 (Begala) discloses a process in which paper or paperboard is made and wherein drainage and/or retention is improved including forming an aqueous cellulosic papermaking slurry that is subject to one or more shear stages, adding sequentially to the slurry a mineral filler, a high molecular weight cationic polymer that is a (meth)acrylamide polymer, and a medium molecular weight anionic polymer.

U.S. Pat. No. 5,185,062 (Begala) discloses a process in which paper or paperboard is made and wherein drainage and/or retention is improved including forming an aqueous cellulosic papermaking slurry that is subject to one or more shear stages, adding sequentially to the slurry a (meth)acrylamide polymer and a medium molecular weight anionic polymer having at least 20 mole percent ionizable mer units including at least 10 mole percent sulfonate-containing mer units.

U.S. Pat. No. 4,313,790 (Pelton et al) discloses a papermaking process for simultaneously increasing the retention of fines, fillers and pigments and decreasing the deposition of pitch on the papermaking apparatus comprising adding to an aqueous wood slurry a poly(oxyethylene) and a kraft lignin product.

U.S. Pat. No. 4,347,100 (Brucato) discloses a method of producing paper having improved bursting strength from mechanical or thermomechanical pulp comprising defibering wet wood by mechanical attrition to form mechanical or thermomechanical pulp, processing the pulp to form a furnish, incorporating into the pulp at an elevated temperature and pressure an anionic organic polyelectrolyte or polymer to improve bursting strength, and adding to the furnish a cationic organic polyelectrolyte or polymer. The patent states that the anionic organic polyelectrolyte or polymer causes dispersion of lignin and retards deposition of lignin to improve the bursting strength. This patent discloses that the anionic polyelectrolyte or polymer must be incorporated into the pulp by cooking at elevated temperature and pressure before or during the refining or defibering stage to achieve the desired end result of paper having improved bursting strength. This patent states that the anionic organic polyelectrolyte or polymer is a polymeric sulfonate.

U.S. Pat. No. 4,606,790 (Youngs et al) discloses a method of preparing an electrically conductive multi-ply structure for intercepting and dissipating electrostatic charges and discharges comprising forming in a mixing vessel an aqueous slurry consisting essentially of a fibrous material, particles of an inorganic electrically conductive substance and an electroconductive polymer dispersant, dispersing the particles in the mixing vessel in the presence of the fibrous material and the polymer dispersant, forming a plurality of separate aqueous slurries consisting essentially of a non-conductive fibrous material, transporting the slurry containing the particles of the conductive substance from the mixing vessel to a paper forming machine, and adding a retention aid polymer to the slurry. This patent states that the electroconductive polymer dispersant is a cationic amine-substituted polymethacrylate or an anionic alkali metal polyacrylate or lignosulfonate.

U.S. Pat. No. 4,145,246 (Goheen et al) discloses a linerboard composition and a process for producing the linerboard composition having a percent mullen of at least 80%, including a replacement quantity of sulfite-modified thermomechanical pulp. This patent states that the process for producing a linerboard composition comprises imparting mechanical attrition forces to undefibered lignocellulose which has been subjected to elevated temperature and pressure, adding a sulfite chemical to the lignocellulose prior to, during, or subsequent to the initial mechanical attrition, subjecting the sulfite-treated lignocellulose to a second mechanical attrition step, forming an aqueous linerboard furnish including at least 25% by weight of the sulfite-modified thermomechanical pulp, depositing the furnish on a foraminous surface to produce a wet linerboard web, and drying the linerboard web.

U.S. Pat. No. 3,180,787 (Adams) discloses a method for increasing the flexural strength of paper comprising adding a water soluble lignosulfonate salt to a water slurry of cellulose pulp, adding a polyethylene polyamine thereby precipitating insoluble polyethylene polyamine lignosulfonate, and forming the pulp fibers with adhered insoluble precipitate into a continuous paper web.

U.S. Pat. No. 4,772,332 (Nemeh et al) discloses a heat stabilized dispersed slurry of particles of chemically bulked hydrous kaolin clay pigment for use in coating or filling paper and method for preparing same. The patent states that the process comprises preparing a fluid aqueous suspension of kaolin clay, adding thereto a cationic polyelectrolyte for flocculating the clay suspension, filtering the suspension, washing the filtered clay, adding to the filtered clay a dispersant that is a combination of a polyacrylate salt, an anionic water soluble lignosulfonate and a water-soluble naphthalene sulfonate formaldehyde complex to provide a fluid suspension of bulked clay free from a phosphate dispersant.

U.S. Pat. No. 3,985,937 (Fife) discloses a corrugating medium laminating adhesive comprising a polymer latex emulsion adhesive containing polyvinyl acetate homopolymers and styrenebutadiene polymers admixed in water with a clay, a paraffin wax, a polyalkylene glycol wetting agent and a lignosulfonate dispersant.

U.S. Pat. No. 3,849,184 (Roberts) discloses a coated paperboard containing paperboard consisting of at least one ply consisting essentially of cellulosic fibrous materials, and a coating on at least one surface thereof comprising a water soluble lignosulfonate salt and a non-reactive hydrophobic waxy material.

U.S. Pat. No. 3,758,377 (Fife) discloses a process for the preparation of a paper sheet by treating the cellulosic fibers in an aqueous slurry with a mixture of a lignosulfonate and an isoprene resin stabilized with an urea-formaldehyde resin.

TAPPI, Papermakers Conference Proceedings, Book 1, pp. 115–186, (Atlanta, Ga.—Apr. 18–21, 1993) discloses microparticle systems such as for example, a system having a cationic starch or cationic polyacrylamide or anionic polymers and an anionic silica colloid or bentonite or alumina sol for improving dewatering, retention, formation and dry strength.

TAPPI, The Journal Of The Technical Association Of The Pulp And Paper Industry, Vol. 63, No. 6, pp. 63–66 (June, 1980) authorized by C. H. Tay, discloses that water soluble substances such as lignosulfonate originating from wood constituents deactivate cationic polyelectrolytes used for filler retention.

Colloids And Surfaces, Vol. 64, pp. 223–234 (1992), co-authored by P. Li and R. Pelton, discloses that cationic poly (diallyldimethyl ammonium chloride) increased the efficiency of the displacement washing of aqueous kraft lignin from a bed of glass beads. This publication states that improved washing results when the poly (diallyldimethyl ammonium chloride) concentration is high enough to form an insoluble complex with lignin.

TAPPI, Contaminant Problems And Strategies In Wastepaper Recycling, Seminar Notes (Madison, Wis.) pp. 91–96 (Apr. 24–26, 1989), authored by T. H. Wegner, discloses that pulping liquors, such as kraft lignin and saponified extractives, used in papermaking are a major source of white water contaminants and adversely affect the performance of a cationic polyacrylamide used as a drainage aid. More specifically, this publication states that kraft lignin completely negated the effectiveness of polyacrylamide as a drainage aid, and that fines retention was also adversely affected.

EUCEPA/ATICELCA, Devt. & Trends in Sci. & Technol. of Pulp & Pmkg., Vol. 2, Paper No. 31, pp. 1–22 (Oct. 6–10, 1986), co-authored by D. Ahrabi, L. Odberg and G. Strom, discloses that in closed white water systems anionic polymers such as, for example, lignin and lignosulfonate, interfere strongly with cationic polymers that are used to improve retention and drainage on the paper machine.

It will be appreciated by those skilled in the art that the above mentioned background technical publications teach against the addition of lignin or modified lignin to paper furnishes having a cationic component. Therefore, it will be understood by those skilled in the art that applicants have discovered unexpectedly that the composition and process of the instant invention comprising adding a modified lignin to an aqueous cellulosic furnish having a high molecular weight cationic polymer component results in producing paper or paperboard having improved drainage, retention and formation properties that are superior to results of others previously achieved.

In spite of this background material, there remains a very real and substantial need for a composition and process for making improved paper or paperboard in the areas of drainage, retention, or formation, and combinations thereof.

SUMMARY OF THE INVENTION

The present invention has met the above-described needs. The present invention provides a process in which paper or paperboard having unexpectedly improved properties is made by forming an aqueous cellulosic paper furnish, adding to the furnish an effective amount, based on the dry weight of the solids of the furnish, of (A) a high molecular weight cationic polymer and (B) a modified lignin, draining the slurry to form a sheet and drying the sheet. The weight ratio of the cationic polymer (A) to the modified lignin (B) is from about 10:1 to 1:10, on an active basis, more preferably from about 5:1 to 1:5, and most preferably from about 2:1 to 1:2.

In a preferred embodiment of this invention, the process as described herein is provided wherein the modified lignin is selected from the group consisting of sulfonated lignin, carboxylated lignin, oxidized lignin, and salts thereof. In another preferred embodiment of this invention, the process wherein the sulfonated lignin has a degree of sulfonation of from about 0.1 to 10 moles of sulfonic acid groups per 1000 unit weight of the lignin is included.

In yet another embodiment of this invention, paper or paperboard produced by the process of this invention is provided wherein the paper or paperboard has improved properties in the areas of retention, drainage or formation, and combinations thereof.

Another embodiment of this invention provides a process in which paper or paperboard is made by forming an aqueous cellulosic paper furnish comprising subjecting the furnish to one or more shear stages, adding to the furnish prior to at least one of the shear stages a high molecular weight cationic polymer (A), adding to the furnish subsequent to the addition of the cationic polymer and at least one shear stage subsequent there to, a modified lignin (B), draining the furnish to form a sheet and drying the sheet. The weight ratio of the cationic polymer (A) to the modified lignin (B) is from about 10:1 to 1:10, on an active basis, more preferably from about 5:1 to 1:5, and most preferably from about 2:1 to 1:2.

Another embodiment of this invention provides a composition comprising (a) an aqueous cellulosic furnish, (b) a high molecular weight cationic polymer, and (c) a modified lignin wherein the ratio of the cationic polymer to the modified lignin is from about 10:1 to 1:10, on an active basis, more preferably from about 5:1 to 1:5 and most preferably from about 2:1 to 1:2.

In another embodiment of this invention, paper or paperboard is provided comprising the composition of this invention.

DETAILED DESCRIPTION OF THE INVENTION

The instant invention is directed to a process in which paper or paperboard having improved properties is made and a composition for improving drainage, retention, or formation, and combinations thereof in the manufacture of paper or paperboard.

As used herein, the term "furnish" refers to all paper and paperboard furnishes based on, for example, but not limited to, mechanical pulp, semi-bleached kraft pulp, unbleached kraft pulp and/or unbleached sulfite pulp.

As used herein, the term "active basis" means a concentration of additive based on the solids in the stock solution.

As used herein, the term "effective amount" refers to that amount of the composition necessary to bring about a desired result, such as, for example, the amount needed to improve drainage, retention, or formation, and combinations thereof in the manufacture of paper or paperboard.

The present invention provides a composition comprising (a) an aqueous cellulosic furnish, (b) a high molecular weight cationic polymer, and (c) a modified lignin, wherein the ratio of the cationic polymer to the modified lignin is from about 10:1 to 1:10, on an active basis. The modified lignin used in the instant invention can be derived from the kraft pulping process and may be, for example, but not limited to, fractionated lignins in terms of molecular weight, purified or may be used in either the protonated or salt forms. In a preferred embodiment of this invention, the modified lignin is selected from the group consisting of sulfonated lignin, carboxylated lignin, oxidized lignin and salts thereof.

The modified lignin used in the instant invention can be derived from the sulfite pulping process for example, but not limited to, a lignin adduct copolymerized with formaldehyde resulting in a modified lignin having a weight average molecular weight greater than about 50,000 such as for example Dynasperse A commercially available from Lignotech USA, Inc., Greenwich, Conn.

In a most preferred embodiment of this invention, the composition as described herein includes a sulfonated lignin that has a degree of sulfonation of from about 0.1 to 10 moles of sulfonic acid groups per 1000 unit weight of the lignin.

In a preferred embodiment of this invention, the composition as described herein includes wherein the sulfonated lignin has a weight average molecular weight of greater than about 2,500, more preferably greater than about 10,000, and most preferably greater than about 50,000.

The composition of the instant invention, as described herein, preferably includes wherein the weight ratio of the cationic polymer to the modified lignin is from about 5:1 to 1:5 and most preferably is from about 2:1 to 1:2.

In another embodiment of this invention, the cationic polymer of the instant composition is derived from at least one cationic monomer selected from the group consisting of a quaternary dialkyldiallyl ammonium monomer, methacryloyloxyethyl trimethyl ammonium chloride, methacryloyloxyethyl trimethyl ammonium methosulfate, acrylamido propyl trimethyl ammonium chloride, methacrylamido propyl trimethyl ammonium chloride, acryloyloxyethyl trimethyl ammonium chloride, quaternized derivatives of N, N-dimethyl amino ethyl methacrylate, dimethyl amino ethyl acrylate, diethyl amino ethyl acrylate, dibutyl amino ethyl methacrylate, dimethyl amino methyl acrylate, dimethyl amino methyl methacrylate, diethyl amino propyl acrylate, diethyl amino propyl methacrylate, acryloyloxyethyl trimethyl ammonium methosulfate, amino methylated polyacrylamide, and combinations thereof.

As used herein, the term "dialkyldiallyl ammonium monomer" refers to any water soluble monomer of the formula [DADAAX–], which represents dialkyldiallyl ammonium X–, wherein each alkyl is independently selected from an alkyl group of from about 1 to 18 carbon atoms in length, and preferably from about 1 to 4 carbon atoms, and wherein X– is any suitable counterion. Preferably, the counterions are selected from the group consisting of conjugate bases of acids having an ionization greater than $10^{-13}$, and more preferably selected from the group consisting of a halide, hydroxide, nitrate, acetate, hydrogen sulfate, methyl sulfate, and primary phosphates. The halide may be any halide, and more preferably is selected from the group consisting of fluoride, bromide and chloride. Preferably, the quaternary dialkyldiallyl ammonium halide monomer is selected from the group consisting of dimethyl diallyl ammonium chloride, diethyl diallyl ammonium chloride, dimethyl diallyl ammonium bromide, and diethyl diallyl ammonium bromide.

It is noted that the cationic polymer component of the composition of this invention may contain one or more other mer units without departing from the concept of this invention. Copolymers, terpolymers, etc., such as, for example, polymers comprising dimethyl diallyl ammonium chloride and acryloyloxyethyl trimethyl ammonium chloride may be employed as the cationic polymer component of the composition of the instant invention. In a preferred embodiment of this invention, the cationic polymer is a copolymer derived from at least one of the hereinbefore mentioned cationic monomers and of at least one of a nonionic monomer selected from the group consisting of acrylamide, methacrylamide, diacetone acrylamide, and N, N-dimethyl acrylamide, wherein the weight ratio of the cationic monomer to the nonionic monomer is from about 99:1 to 1:99. Preferably, the weight ratio of the cationic monomer to the nonionic monomer is from about 24:76 to 72:28 and most preferably is from about 26:74 to 52:48. It will be appreciated by those skilled in the art that the ratio of mer units in such copolymers generally is determined by the quantity of cationic units necessary in the instant composition to impart the desired drainage, retention and formation, or combinations thereof for the manufacture of a particular paper or paperboard. Further, additional cationic mer units may be present.

It will be understood by those skilled in the art that the cationic polymer component and the modified lignin component of the composition of this invention, as described herein, are water soluble or water dispersible.

It will be appreciated by those skilled in the art that when employing diacetone acrylamide as the nonionic monomer, it is preferable to employ less than about 35 weight percent of diacetone acrylamide for achieving adequate water solubility. It will be understood that employing more than 35 weight percent of diacetone acrylamide results in reduced water solubility.

An effective amount of the composition of the instant invention should be employed. It will be appreciated by those skilled in the art that the dosage of the composition added to the aqueous cellulosic furnish being treated is dependent on the degree of retention, drainage and formation desired. At least about 0.1 pounds per ton based on the dry weight of solids in the furnish should be added.

The high molecular weight cationic polymer component of the instant composition has a weight average molecular weight above about 300,000 and preferably above about 1,000,000. Most preferably, the high molecular weight cationic polymer component of the instant composition has a weight average molecular weight above about 2,000,000.

The composition of the instant invention can generally be successfully added to aqueous cellulosic furnishes over the entire pH range customarily employed in the papermaking process. Preferably, the composition of the instant invention is added to aqueous cellulosic furnishes having a pH from about 3 to 10. Therefore, it will be appreciated by those skilled in the art that the composition of the instant invention may be added to aqueous cellulosic paper furnishes that are acid, alkaline, or neutral in character. It will be understood by those skilled in the art that generally an acid furnish has a pH range from about 3.0 to 5.5, an alkaline furnish has a pH range from about 7.0 to greater than about 10.0 , and a neutral furnish has a pH range of from about 5.5 to 7.0.

In another embodiment of this invention, a process is provided for in which paper or paperboard having improved properties is made by forming an aqueous cellulosic paper furnish which comprises adding to the furnish an effective amount, based on the dry weight of the solids of the furnish, of (A) a high molecular weight cationic polymer, as hereinbefore described, and (B) a modified lignin, as hereinbefore described, draining the furnish to form a sheet and drying the sheet, wherein the weight ratio of the cationic polymer (A) to the modified lignin (B) is from about 10:1 to 1:10, on an active basis, preferably from about 5:1 to 1:5, and most preferably about 2:1 to 1:2. In another embodiment of the instant invention, the process, as hereinbefore described, includes wherein the modified lignin is selected from the group consisting of sulfonated lignin, carboxylated lignin, oxidized lignin and salts thereof. Preferably, the process includes wherein the sulfonated lignin has a degree of sulfonation of from about 0.1 to 10 moles of sulfonic acid groups per 1000 unit weight of the lignin.

In another embodiment of this invention, the process, as hereinbefore described, includes wherein the sulfonated lignin has a weight average molecular weight greater than about 2,500, preferably greater than about 10,000, and most preferably greater than about 50,000.

In a further embodiment of this invention the process includes wherein the cationic polymer is derived from at least one cationic monomer, as hereinbefore described. More preferably the process of this invention, as hereinbefore described includes wherein the cationic polymer is a copolymer derived from at least one of the cationic monomers and of at least one of the nonionic monomers as hereinbefore described. The instant process includes wherein the weight ratio of the cationic monomer to the nonionic monomer is from about 99:1 to 1:99, preferably from about 24:76 to 72:28, and most preferably from about 26:74 to 52:48.

The process of the instant invention includes adding an effective amount of the composition to the aqueous cellulosic paper furnish. It will be appreciated by those skilled in the art that the dosage of the composition added to the aqueous cellulosic paper furnish is dependent on the drainage, retention and formation parameters desired. At least about 0.1 pounds per ton of the cationic polymer should be added to the furnish based on the dry weight of solids in the furnish. The instant process includes wherein at least about 0.1 pounds of the modified lignin is added to the furnish based on the dry weight of solids in the furnish.

It is believed that the pH of the aqueous cellulosic paper furnish is unimportant as the instant composition is effective in treating aqueous cellulosic paper furnishes having a wide range of alkaline, neutral and acidic pH's. Preferably, the process of the instant invention includes wherein the aqueous cellulosic paper furnish has a pH from about 3 to 10.

In another embodiment of the instant invention, a process is provided in which paper or paperboard is made by forming an aqueous cellulosic paper furnish comprising subjecting the furnish to one or more shear stages, adding to the furnish prior to at least one of the shear stages a high molecular weight cationic polymer, as hereinbefore described, adding to the furnish subsequent to the addition of the cationic polymer and at least one shear stage subsequent thereto, a modified lignin, as hereinbefore described, draining the furnish to form a sheet and drying the sheet, wherein the weight ratio of the cationic polymer to the modified lignin is from about 10:1 to 1:10, on an active basis, preferably from about 5:1 to 1:5, and most preferably from about 2:1 to 1:2.

A further embodiment of the instant invention provides a process, as hereinbefore described, including the cationic polymer derived from at least one cationic monomer, as hereinbefore described, and combinations thereof. Preferably, the instant invention includes the process wherein the cationic polymer is a copolymer derived from at least one of the cationic monomers, as hereinbefore described, and of at least one of the nonionic monomers, as hereinbefore described. The weight ratio of the cationic monomer to the nonionic monomer is from about 99:1 to 1:99.

Another embodiment of this invention includes paper or paperboard produced by the process of the instant invention, as hereinbefore described, wherein the paper or paperboard has improved properties in the areas of retention, drainage, or formation and combinations thereof.

It will be appreciated by those skilled in the art that the composition and process of this invention may be employed in conjunction with other additives used during the manufacture of paper or paperboard such as, but not limited to, fillers, pigments, binders, and strength aids.

The cationic polymers of the instant composition may be prepared using any conventional polymerization technique that is well known by those skilled in the art.

The composition of the instant invention may be added to the paper furnish as hereinbefore described at any convenient point prior to sheet formation. It will be appreciated by those skilled in the art that the exact points of addition are mill specific. Preferably, the composition of this invention is added to thin diluted aqueous cellulosic paper furnish. Any suitable method of addition known in the art can be utilized. A preferred method of addition includes adequate dilution to accomplish dispersion of the composition throughout the furnish.

It will be appreciated by those skilled in the art that the process and the composition of the instant invention does not contain a solid or particulate component in comparison to currently available microparticle technology employing such as for example silica, bentonite or alum. The process of this invention, therefore, provides a more economical process of improving drainage, retention, or formation and combinations thereof, of paper or paperboard without insoluble residue or solids buildup.

EXAMPLES

The following examples demonstrate the invention in greater detail. These examples are not intended to limit the scope of the invention in any way. In the examples, the following products were used:

Cationic Polymer A is a 25 weight % active methacryloyloxyethyl trimethyl ammonium chloride/acrylamide copolymer available from Calgon Corporation (Pittsburgh, Pa.), comprising about 24% by weight methacryloyloxyethyl trimethyl ammonium chloride and about 76% by weight acrylamide.

Cationic Polymer B is a 25 weight % active acrylamido propyl trimethyl ammonium chloride/acrylamide copolymer available from Calgon Corporation (Pittsburgh, Pa.), comprising about 24% by weight acrylamido propyl trimethyl ammonium chloride and about 76% by weight acrylamide.

Cationic Polymer C is a 25 weight % active methacrylamido propyl trimethyl ammonium chloride/acrylamide copolymer available from Calgon Corporation (Pittsburgh, Pa.), comprising about 26% by weight methacrylamido propyl trimethyl ammonium chloride and about 74% by weight acrylamide.

Cationic Polymer D is a 25 weight % active methacryloyloxyethyl trimethyl ammonium chloride/acrylamide copolymer available from Calgon Corporation (Pittsburgh, Pa.), comprising about 72% by weight methacryloyloxyethyl trimethyl ammonium chloride and about 28% by weight acrylamide.

Cationic Polymer E is a 25 weight % active methacryloyloxyethyl trimethyl ammonium chloride/acrylamide copolymer available from Calgon Corporation (Pittsburgh, Pa.), comprising about 52% by weight methacryloyloxyethyl trimethyl ammonium chloride and about 48% by weight acrylamide.

LSA is a modified sulfonated kraft lignin polymer commercially available from Westvaco, Chemical Division (Charleston Heights, S.C.) and chemically is a sodium salt of lignosulfonic acid having a weight average molecular weight of about 60,000 and a degree of sulfonation of about 1.5 moles of sulfonic acid groups per 1000 unit weight of the lignin.

LSB is a modified sulfonated kraft lignin polymer commercially available from Westvaco, Chemical Division (Charleston Heights, S.C.) and chemically is a sodium salt of lignosulfonic acid having a weight average molecular weight of about 12,000 and a degree of sulfonation of about 1.5 moles sulfonic acid groups per 1000 unit weight of the lignin.

EXAMPLES 1–11

In Examples 1–11, various formulations were tested for their effectiveness in improving the drainage, retention and formation parameters of a stock aqueous cellulosic furnish of a commercial paper mill. This stock aqueous cellulosic furnish had the following make-up: bleached hardwood kraft 250 grams, bleached softwood kraft 250 grams, refined to 350 CSF (Canadian Standard Freeness, well known by those skilled in the art), and followed by the addition of ground calcium carbonate as Opacimite™ 75 grams (English China Clays plc, Theale, United Kingdom), 0.5% by weight cationic starch as Interbond C™ 2.5 grams (A. E. Staley Manufacturing Co., Decatur, Ill., U.S.A.) and 0.25% by weight alkyl ketene dimer (AKD) size as Hercon 70™ 1.25 grams (Hercules, Inc., Wilmington, Del., U.S.A.). This stock aqueous cellulosic furnish had a pH of about 8.5, and a consistency of 0.7202%. The make-up of the composition of each example is shown in Table I.

TABLE I

| EXAMPLE | CATIONIC POLYMER | SHEAR RATE | MODIFIED LIGNIN | FEED RATE (#/T ACTIVE) | DRAIN TIME (SECS/250 MLS) | FORMATION INDEX | % RETENTION | % SHEET ASH RETENTION |
|---|---|---|---|---|---|---|---|---|
| 1 | — | — | — | — | 180 | 26.5 | 76.7 | 16.6 |
| 2 | A | High | — | 2.0 | 153 | 18.4 | 84.9 | 53.8 |
| 3 | A | High | LSA | 2.0/1.0 | 52 | 9.2 | 91.0 | 76.4 |
| 4 | B | High | — | 2.0 | 136 | 18.8 | 84.1 | 52.5 |
| 5 | B | High | LSA | 2.0/1.0 | 62 | 12.7 | 88.9 | 69.9 |

TABLE I-continued

| EX-AMPLE | CATIONIC POLYMER | SHEAR RATE | MODIFIED LIGNIN | FEED RATE (#/T ACTIVE) | DRAIN TIME (SECS/250 MLS) | FORMATION INDEX | % RE-TENTION | % SHEET ASH RE-TENTION |
|---|---|---|---|---|---|---|---|---|
| 6 | C | High | — | 2.0 | 136 | 18.5 | 84.5 | 53.0 |
| 7 | C | High | LSA | 2.0/1.0 | 37 | 5.8 | 92.4 | 80.7 |
| 8 | D | High | — | 2.0 | 139 | 22.4 | 80.0 | 37.4 |
| 9 | D | High | LSA | 2.0/1.0 | 41 | 13.6 | 87.6 | 66.9 |
| 10 | E | High | — | 2.0 | 148 | 20.4 | 81.3 | 43.1 |
| 11 | E | High | LSA | 2.0/1.0 | 38 | 8.5 | 89.8 | 72.5 |

Table I shows the rate of shear, the feed rate, drain time, formation index, percent (%) retention, and percent (%) sheet ash retention for each example. A low rate of shear, as used herein, is defined as less than or equal to about 600 revolutions per minute (rpm). A high rate of shear, as used herein, is defined as greater than or equal to about 1,200 rpm. Feed rate is the amount of active polymer added in pounds (#)per ton (T) of solids in the furnish. Table I shows under the column designated "FEED RATE" for Examples 2, 4, 6, 8 and 10 that 2.0 pounds of one of the listed active cationic polymers, Cationic Polymer A, B, C, D or E, respectively, was added per ton of solids in the furnish. Table I shows under the column designated "FEED RATE" for Examples 3, 5, 7, 9 and 11 that 2.0 pounds of active Cationic Polymer A, B, C, D and E, respectively, and 1.0 pounds of active modified lignin LSA were added per ton of solids in the furnish.

Drain time, as used herein, is the time in seconds for a specific amount of water to drain from a testing apparatus, and is a standard technique well known by those skilled in the art. Table I shows under the column designated "DRAIN TIME" that for Example 3, 250 ml of water drained from the treated furnish in 52 seconds. It is desirable to achieve a drainage time in which a specific amount of water is removed from the furnish in the smallest amount of time over the papermaking process.

The formation index was determined by an M/K Formation Tester commercially available by M/K Systems, Inc., Danvers, Mass. Percent retention is an indication of retention of fiber, filler and fines of a sheet sample. Percent retention was obtained employing a standard technique well known by those skilled in the art. Percent sheet ash retention is an indication of filler retention, such as for example, clay, calcium carbonate or titanium oxide. Percent sheet ash retention was obtained by ashing preweighed sheet samples at about 900 degrees centrigrade employing a standard technique well known by those skilled in the art. The following two paragraphs set forth the drainage and handsheet test procedures employed in the examples.

Drainage Test Procedure

1. A 500 ml sample of well-mixed aqueous cellulosic paper furnish is added to a one liter beaker.
2. Agitation of the furnish is introduced at 1200 rpm, the cationic polymer is added and the timing sequence is started.
3. At the 30 second mark, the agitation is reduced to 600 rpm.
4. At the 40 second mark, the modified lignin is added depending on the formulation of the example as set forth in Table I.
5. At the 60 second mark, the agitation is discontinued and the treated furnish sample is poured into the drainage test apparatus.
6. The test apparatus is then activated and the time required for a specified amount of water to drain from it is measured and recorded.

Handsheet Test Procedure

Steps 1 through 5, above, are duplicated except that the sample size may vary to produce a desired basis weight handsheet, the treated furnish sample is poured into the deckle box of a Noble and Wood handsheet machine and the sheet is prepared employing standard techniques well known by those skilled in the art.

It will be understood that for Example 1 wherein no polymer was added, the hereinabove Drainage and Handsheet Test Procedures followed the same steps without any polymeric aids being added.

Agitation was provided by a Britt Jar Stirring apparatus fitted with a one inch diameter marine prop.

In Example 1, the furnish was fed to the paper forming apparatus without the addition of a cationic polymer or modified lignin. Table I shows that Example 1 had a drainage time of about 180 seconds per 250 ml of water, a formation index of about 26.5, a percent retention of about 76.7 and a % sheet ash retention of about 16.6.

Table I shows that when the composition of Example 2, a commercially available cationic polymer composition (A) was added to the furnish, a drain time of 153 seconds, a formation index of 18.4, a % retention of 84.9 and a % sheet ash retention of 53.8 was achieved.

Table I shows that Example 4, containing a cationic polymer (B), when added to the furnish resulted in a paper product having a drainage time of about 136 seconds, a formation index of about 18.8, a % retention of 84.1 and a % sheet ash retention of about 52.5. Further, the data of Table I, it will be appreciated by those skilled in the art that each parameter of drainage, retention and formation are improved when the cationic polymers A, B, C, D and E of Examples 2, 4, 6, 8 and 10, respectively, are added to the furnish in comparison to the results obtained when no polymer (Example 1) is added to the furnish.

The data of Table I clearly shows that the compositions of the present invention, Examples 3, 5, 7, 9 and 11, when added to the stock aqueous cellulosic furnish greatly improved the drainage, % retention, % sheet ash retention and formation parameters of the resulting paper in comparison to currently available additives such as the cationic polymers A, B, C, D and E of Examples 2, 4, 6, 8 and 10, respectively.

Table I shows for the compositions of the instant invention, Examples 3, 5,7, 9 and 11, that the active cationic polymer component of the compositions of the instant invention was added in the amount of 2.0 pounds per ton of solids in the furnish and that the active modified lignin polymer component, LSA, of the composition of the instant invention was added in the amount of 1.0 pound per ton of solids in the furnish. The data set forth in Table I shows that the composition of Example 3 when added to the furnish resulted in paper having a drainage time of 52 seconds, a formation index of 9.2, a % retention of 91, and a % sheet ash retention of 76.4. It will be appreciated by those persons skilled in the art, that the compositions of the instant invention dramatically improve the drainage, formation and retention parameters of the resulting paper in comparison to current commercially available additives, such as the use of cationic polymers alone.

Table I shows that the composition of this invention set forth in Example 7 when added to the furnish resulted in paper having a drainage time of 37 seconds, a formation index of 5.8, a % retention of 92.4 and a % sheet ash retention of 80.7. The composition of the instant invention of Example 7 greatly improved the parameters of drainage, formation and retention compared to the currently available additive Cationic Polymer C when used alone. The data of Table I shows that all of the compositions of the instant invention, Examples 3, 5, 7, 9 and 11 produced superior results in comparison to employing solely the cationic polymer compositions of Examples 2, 4, 6, 8 and 10. The data of Table I shows for the compositions of the instant invention, Examples 3, 5, 7, 9 and 11, that by varying the amounts of the active cationic polymer and active modified lignin components of the compositions of the instant invention added per ton of dry weight of solids in the furnish, one or more of the parameters of drainage, retention and formation may be modified as desired.

EXAMPLES 12–18

In Examples 12–18, various formulations were tested for their effectiveness in improving the drainage, retention and formation parameters of a stock aqueous cellulosic furnish of a commercial paper mill. This stock aqueous cellulosic furnish had the following make-up: 50/50 weight % hardwood kraft/softwood kraft blend, a Schopper-Riegler Freeness 310 milliliters (known by those skilled in the art), and followed by the addition of 15% by weight, ground calcium carbonate as Opacimite™ (English China Clays plc, Theale, United Kingdom), 0.5% by weight of cationic starch as Interbond C™ (A. E. Staley Manufacturing Co., Decatur, Ill., U.S.A.), and 0.25% by weight AKD size as Hercon 70™ (Hercules, Inc., Wilmington, Del., U.S.A.). This stock aqueous cellulosic furnish had a pH of about 8.0, and a consistency of 0.7%. The make-up of the composition of each example is shown in Table II.

TABLE II

| EXAMPLE | CATIONIC POLYMER | SHEAR RATE | MODIFIED LIGNIN | FEED RATE (#/T ACTIVE) | DRAIN TIME (SECS/200 MLS) | FORMATION INDEX | % RETENTION |
|---|---|---|---|---|---|---|---|
| 12 | — | — | — | — | 103 | 26.5 | 76 |
| 13 | A | High | — | 2.0 | 92 | 18.4 | 84.9 |
| 14 | A | High | LSB | 2.0/1.0 | 62 | 15.2 | 86.4 |
| 15 | B | High | — | 2.0 | 80 | 18.8 | 84.1 |
| 16 | B | High | LSB | 2.0/1.0 | 74 | 17.5 | 84.6 |
| 17 | C | High | — | 2.0 | 81 | 18.5 | 84.5 |
| 18 | C | High | LSB | 2.0/1.0 | 45 | 11.8 | 89.0 |

In Example 12, the furnish was fed to the paper forming apparatus without the addition of a cationic polymer or modified lignin. Table II shows that when cationic polymers A, B and C of Examples 13, 15 and 17, respectively, are added to the furnish the parameters of drainage, retention and formation are improved in comparison to when no polymer (Example 12) is added. More importantly, the data of Table II clearly shows that the compositions of the present invention, Examples 14, 16 and 18, when added to the stock aqueous cellulosic furnish greatly improved the drainage, retention and formation parameters of the resulting paper in comparison to employing solely the cationic polymers A, B and C of Examples 13, 15 and 17, respectively.

From the above data, therefore, it will be appreciated by those skilled in the art that the cellulosic, modified lignin and cationic polymer composition and process for making paper or paperboard of the instant invention significantly improve the parameters of drainage, retention, formation and combinations thereof over conventional known cationic polymer technology and microparticle technology.

Whereas particular embodiments of the instant invention have been described for the purposes of illustration, it will be evident to those skilled in the art that numerous variations and details of the instant invention may be made without departing from the instant invention as defined in the appended claims.

What is claimed is:

1. A process in which paper or paperboard is made by forming an aqueous cellulosic paper furnish having improved properties in the areas of drainage, retention, and formation which comprises adding to said furnish at least about 0.1 pounds per ton, based on the dry weight of the solids of said furnish, of (A) a high molecular weight cationic polymer having a weight average molecular weight greater than about 1 million wherein said cationic polymer is a copolymer derived from a cationic monomer that is selected from a group consisting of a methacryloyloxyethyl trimethyl ammonium chloride, acrylamido propyl trimethyl ammonium chloride, and methacrylamido propyl trimethyl ammonium chloride, and a nonionic monomer that is acrylamide wherein the weight ratio of said cationic monomer: said nonionic monomer is from about 99:1 to 1:99, and at least about 0.1 pounds per ton, based on the dry weight of the solids of said furnish, of (B) a modified lignin which is a sulfonated lignin having a weight average molecular weight greater than about 10,000, draining the furnish to form a sheet, and drying said sheet, wherein the weight ratio of said cationic polymer (A): said modified lignin (B) is from about 10:1 to 1:10, on an active basis.

2. The process of claim 1 wherein said sulfonated lignin has a degree of sulfonation from about 0.1 to 10 moles of sulfonic acid groups per 1,000 unit weight of said lignin.

3. The process of claim 1 wherein said cationic monomer is methacrylamido propyl trimethyl ammonium chloride and wherein the weight ratio of said cationic monomer: said nonionic monomer is 26:74.

4. The process of claim 1 wherein the weight ratio of said cationic polymer (A): said modified lignin (B) is from about 5:1 to 1:5.

5. The process of claim 1 wherein the weight ratio of said cationic polymer (A): said modified lignin (B) is from about 2:1 to 1:2.

6. The process of claim 1 wherein said aqueous cellulosic paper furnish has a pH from about 3 to 10.

7. Paper or paperboard produced by the process of claim 1, wherein said paper or paperboard has improved properties in the areas of retention, drainage and formation.

8. A process in which paper or paperboard is made by forming an aqueous cellulosic paper furnish having improved drainage, retention, and formation, comprising subjecting said furnish to one or more shear stages, adding to said furnish prior to at least one of said shear stages a high molecular weight cationic polymer (A) having a weight average molecular weight greater than about 1 million wherein said cationic polymer is a copolymer derived from a cationic monomer that is selected from a group consisting of a methacryloyloxyethyl trimethyl ammonium chloride, acrylamido propyl trimethyl ammonium chloride, and methacrylamido propyl trimethyl ammonium chloride, and a nonionic monomer that is acrylamide wherein the weight ratio of said cationic monomer: said nonionic monomer is from about 99:1 to 1:99, adding to said furnish subsequent to said addition of said cationic polymer and at least one shear stage subsequent thereto, a modified lignin (B) which is a sulfonated lignin having a weight average molecular weight greater than about 10,000, draining said furnish to form a sheet, and drying said sheet, wherein the weight ratio of said cationic polymer (A): said modified lignin (B) is from about 10:1 to 1:10, on an active basis, and said cationic polymer (A) and modified lignin (B) are each present in an amount of at least about 0.1 pounds per ton, based on the dry weight of solids in said furnish.

9. The process of claim 8 wherein said sulfonated lignin has a degree of sulfonation of from about 0.1 to 10 moles of sulfonic acid groups per 1,000 unit weight of said lignin.

10. The process of claim 8 wherein said cationic monomer is methacrylamido propyl trimethyl ammonium chloride and wherein the weight ratio of said cationic monomer: said monomer is 26:74.

11. The process of claim 8 wherein said aqueous cellulosic paper furnish has a pH from about 3 to 10.

12. Paper or paperboard produced by the process of claim 8, wherein said paper or paperboard has improved properties in the areas of retention, drainage and formation.

* * * * *